US005992447A

United States Patent [19]

Miller et al.

[11] Patent Number: 5,992,447

[45] Date of Patent: Nov. 30, 1999

[54] DEVICE FOR FILLING VINYL LINED POOLS

[76] Inventors: Russell Miller, 4201 Wyckford Rd., Apex, N.C. 27502; Michael Oyer, 512 Cascade Dr., Lilburn, Ga. 30247

[21] Appl. No.: 09/146,804

[22] Filed: Sep. 4, 1998

[51] Int. Cl.[6] ..... E03B 1/00

[52] U.S. Cl. ..... 137/392; 137/389; 137/386; 4/508

[58] Field of Search ..... 137/392, 386, 137/389, 393; 4/508, 507, 488

[56] References Cited

U.S. PATENT DOCUMENTS

| | | | |
|---|---|---|---|
| 3,997,925 | 12/1976 | Hough | 4/508 |
| 4,612,949 | 9/1986 | Henson | 4/508 |
| 4,817,217 | 4/1989 | Lively | 4/508 |
| 5,365,617 | 11/1994 | Tarr | 137/392 |
| 5,493,922 | 2/1996 | Ramey et al. | 137/392 |
| 5,878,447 | 3/1999 | Mogab et al. | 4/508 |

*Primary Examiner*—David J. Walczak
*Attorney, Agent, or Firm*—Coats & Bennett, P.L.L.C.

[57] ABSTRACT

A device for filling a swimming pool having a liner and a shell includes a water supply valve to control the flow of water into said swimming pool; a vacuum pump to evacuate air from the space between the liner and the shell as the swimming pool is being filled; a probe for generating a signal when the water in the pool reaches a predetermined height; and a controller responsive to the signal from the probe to shut off said water supply valve and the vacuum pump when water is detected by the probe. A current sensor monitors the current to the vacuum pump and shuts off the water supply valve when the vacuum pump ceases operation. A bypass switch allows the current sensor to be disabled.

18 Claims, 7 Drawing Sheets

DEVICE FOR FILLING VINYL LINED POOLS

FIELD OF THE INVENTION

The present invention relates to the installation of swimming pools and more particularly to the installation of in-ground vinyl lined pools; and the controlling of the water level, and the amount of air in between the liner and the ground.

BACKGROUND OF THE INVENTION

Vinyl lined pools are preferred over poured-in-place concrete pools by many consumers. Vinyl lined pools are typically constructed of a series of prefabricated metal panels which are assembled on site to form the side walls of the pool. The bottom of the pool is a type of concrete that is poured in place after the walls are assembled. A vinyl liner is then inserted into the shell and smoothed against the side walls and bottom of the pool. This method of construction is generally less expensive than building a poured in place concrete pool and can be completed in less time.

Another reason consumers prefer vinyl lined pools is its ease of maintenance. Concrete pools require patching and painting at the beginning of each season, whereas the vinyl liner needs replacement only after many years of use. Also, algae and other organisms are less likely adhere to the vinyl liner making it easier to keep clean.

When the liner is installed into a vinyl lined pool, care must be exercised to make sure that air is not trapped between the liner and the shell of the pool. Air pockets are not aesthetically pleasing and increase the likelihood that the liner will be torn during use. To prevent formation of air pockets during installation of the liner, a vacuum pump is used to pull air out of the space between the liner and the shell while the pool is being filled with water.

Generally, it takes anywhere from one day to two days to fill an average size pool using a garden hose attached to a household spigot. The vacuum pump must continue running during this entire period. If the vacuum pump shuts off or otherwise malfunctions, air pockets will form underneath the liner. Once the pool is filled, these air pockets are almost impossible to eliminate.

Currently, no device exists to ensure continuous operation of the vacuum pump while the pool is being filled. Further, it is not practical to continuously monitor the operation of the vacuum pump while the pool is being filled. Therefore, there is a need for a device that will automatically monitor and control the vacuum pump and water supply during the filling of the pool.

SUMMARY OF THE INVENTION

The present invention is a pool-filling device to allow unattended filling of vinyl lined swimming pools. The pool-filling device monitors the operation of the vacuum pump and water level while the pool is being filled. When the pool is filled, the pool-filling device automatically shuts of the water supply to the pool to prevent overfilling. Also, if the vacuum pump shuts off while the pool is being filled, the water supply is automatically turned off as well. Thus, the installer does not need to be present during the entire period of time that the pool is being filled.

The pool-filling device comprises an electronically controlled water supply valve, a probe to detect the level of the water in the pool, a power receptacle for the vacuum pump, and a controller operatively connected to the water supply valve, probe and power receptacle. The water supply valve controls the flow of water into the swimming pool. The input of the water supply valve is connected to a water source. The fill hose connects to the output of the water supply valve. The probe senses the height of the water in the pool and generates a signal when level of the water reaches a predetermined height. A vacuum pump plugs into the power receptacle.

In operation, the pool-filling device monitors the water level in the pool. When the water reaches the level of the probe, a signal is generated. The controller responds to the signal from the probe by shutting off power to the vacuum pump and water supply valve. The controller also includes a current sensor to monitor the operation of the vacuum pump while the pool is being filled. The controller allows water to continue flowing into the pool as long as vacuum pump is drawing current. When current to the vacuum pump is no longer detected, the controller shuts off the power to the water supply valve.

DETAILED DESCRIPTION OF THE INVENTION

Figure 1:
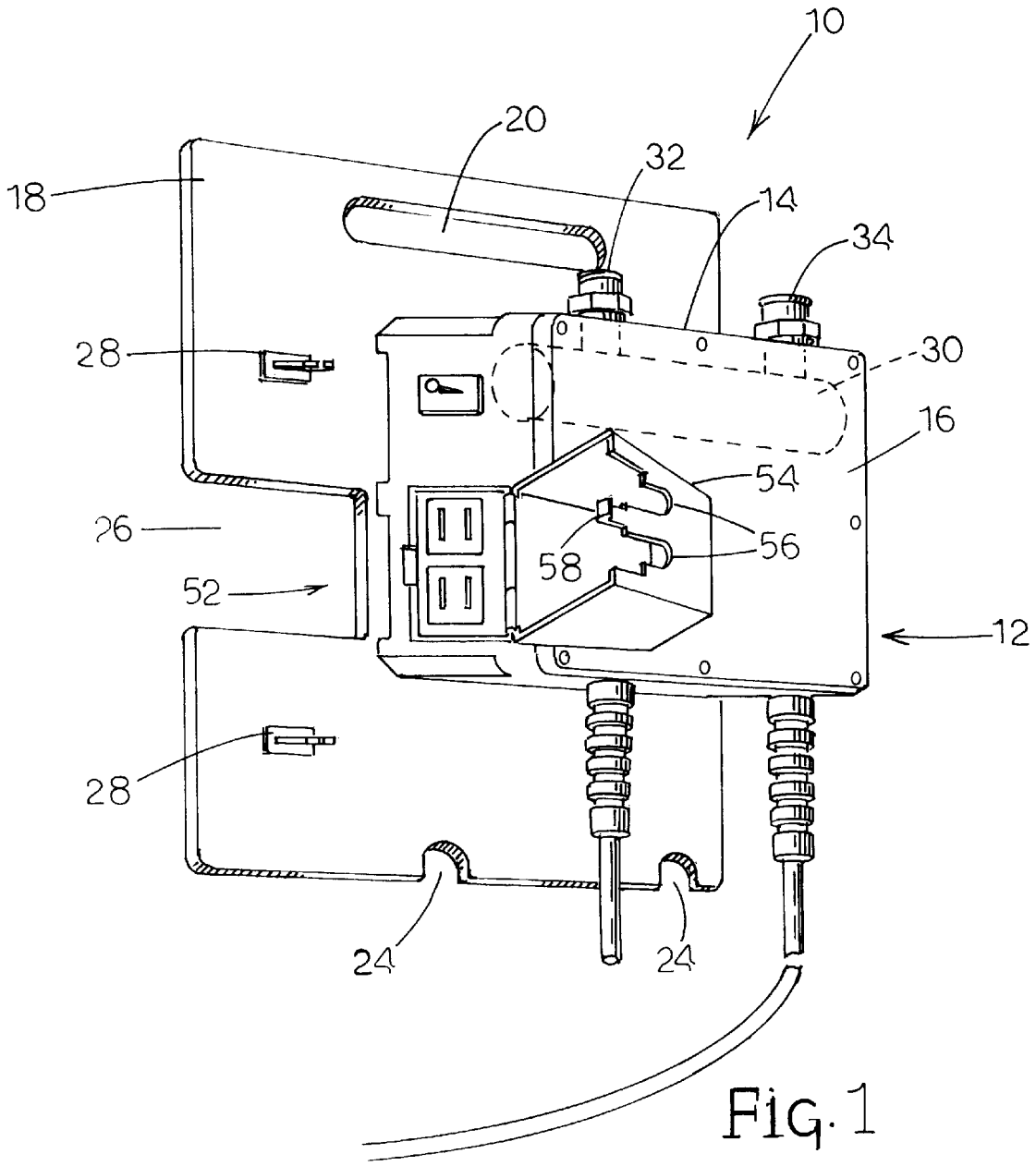
FIG. 1 is a perspective view of the pool-filling device of the present invention.
Figure 3:
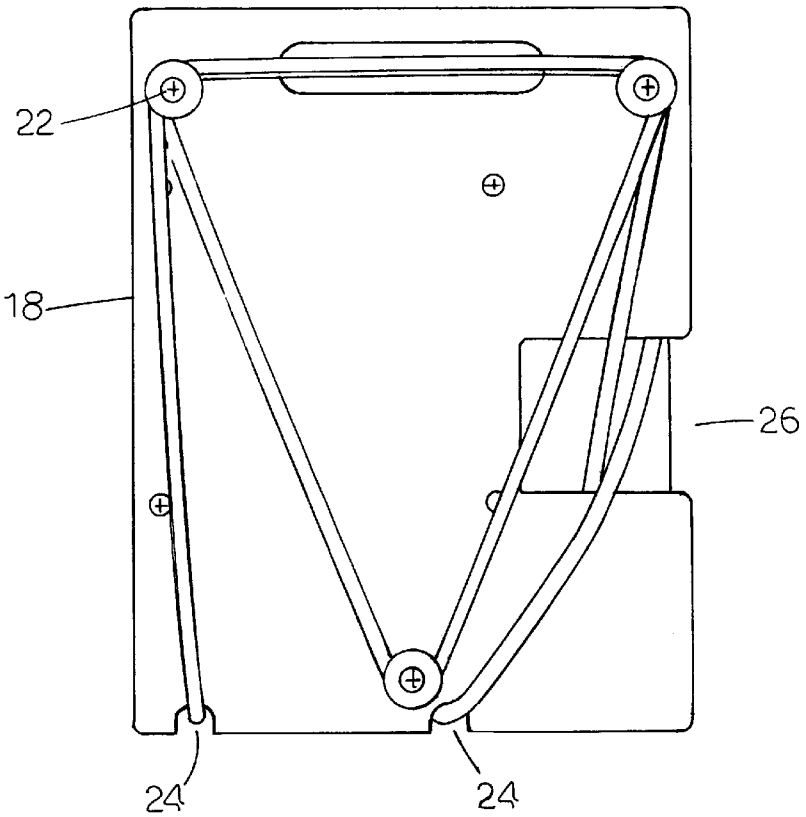
FIG. 3 is a schematic illustration of the probe.
Figure 2:
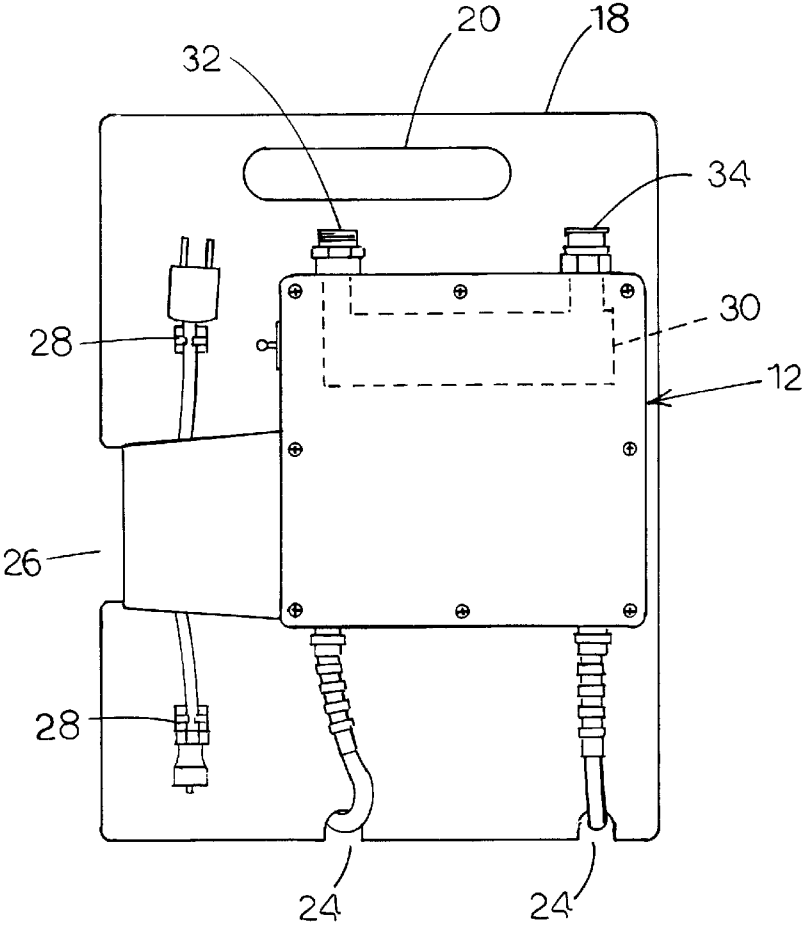
FIG. 2 is a front elevation view of the pool-filling device.

Referring now to the drawings, a preferred embodiment of the present invention will be described. It is understood, however, that the present invention can take on many different embodiments and is not intended to be limited to the embodiments described herein.

FIG. 1 is perspective view of the pool-filling device, indicated generally by the number 10 constructed in accordance with the present invention. The pool-filling device 10 is used in connection with the installation of vinyl-lined pools. The pool-filling device monitors the pool-filling operation and automatically shuts off the flow of water into the pool when the pool is filled to a predetermined level. In addition the pool-filling device 10 monitors the operation of a vacuum pump during the filling operation and shuts off the flow of water in the event that the vacuum pump ceases to operate.

The pool-filling device 10 generally comprises a housing 12, a water supply valve 30, a probe 40, a vacuum pump (not shown), and a control circuit 100. The water supply valve 30 connects to a water source, such as a household spigot, and controls the flow of water into the pool. The probe 40 is used to detect the water in the pool when the water reaches the level of the probe 40. The vacuum pump evacuates air from the space between the pool liner and the shell of the pool. The control circuit 100 monitors the state of the probe 40 and the operation of the vacuum pump. The control circuit 100 shuts off the water supply valve 30 when the probe detects the water or when the vacuum pump ceases to operate.

The housing 12 comprises a generally rectangular case 14 made of metal or plastic with an open front and a removable front cover 16. The cover 16 is secured to the front of the case 14 by screws or other suitable means. A gasket or seal is preferably disposed between the cover 16 and the case 14 of the housing 12. The housing 12 provides a watertight enclosure for the water supply valve 30 and control circuit 100 that are contained in the housing 12.

The housing 12 is mounted to a carrier plate 18 by screws or other suitable means. The carrier plate 18 includes a slot 20 that is used for carrying the device. Three support feet 22 are disposed on the back side of the carrier plate 18. Two cord slots 24 are formed in the bottom edge of the carrier plate 18. A third cord slot 26 is formed along a side edge of the carrier plate 18. Mounted on the front surface of the carrier plate 18 are a pair of cord clips 28. The purpose of the cord clips 28 is to hold the power cord and probe cord when the device is being stored or carried. When not in use, the power cord passes through a first cord slot 24 along the bottom edge of the carrier plate, wraps around the back side of the carrier plate 18, passes through the cord slot 26 in the side of the carrier plate 18, and then engages the uppermost clip 28 on the front of the carrier plate 18. The probe cord passes through a second cord slot 24 in the bottom of the carrier plate 18, wraps around the support feet 22, passes through the slot 26 in the side of the carrier plate 18, and engages the lowermost clip 28 on the front of the carrier plate 18.

The water supply valve 30 is disposed within the case. The water supply valve 30 is a normally closed valve. The water supply valve 30 is connected to an inlet pipe 32 and an outlet pipe 34 that pass through the top of the housing 12. The inlet pipe 32 and outlet pipe 34 are fitted with hose couplings to connect ordinary garden hoses to the water supply valve 30. A first hose connects inlet of the water supply valve 30 to a conventional household spigot. The output of the water supply valve 30 is attached to a second hose that is used to fill the pool. While the disclosed embodiment uses a single water supply valve 30 with one inlet and one outlet, it will be apparent to those skilled in the art that two or more water supply valves 30 or, alternatively, a single water supply valve 30 with multiple inlets and outlets could be used.

Figure 4:
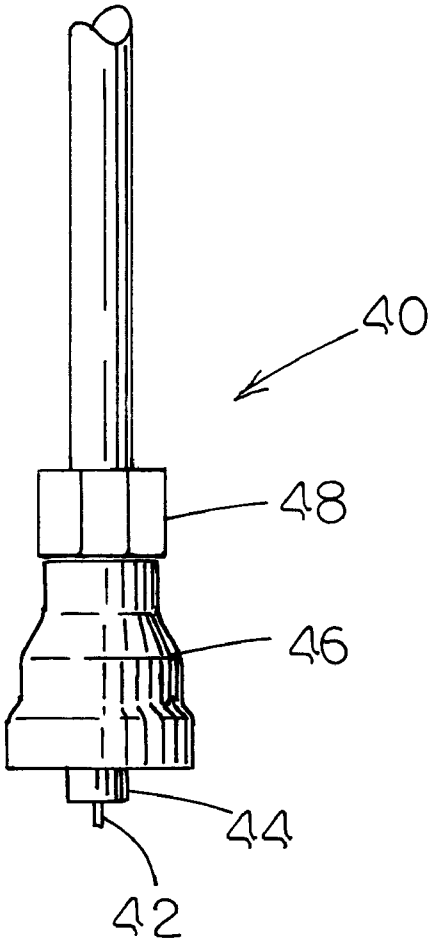
FIG. 4 is a rear elevation view of the pool-filling device.

FIG. 4 illustrates the probe 40. The probe 40 includes a probe tip 42 mounted in an insulator 44, a rain shield 46, and an outer conductor 48. The probe 40 generates a signal when the probe 40 becomes immersed in water sufficiently to establish an electrical connection between the probe tip 42 and the outer conductor 48. The rain shield 46 shields the probe tip 42 from heavy rains. The rain shield 46 is formed so that the rain will not continually bombard the probe tip 42 and cause the probe 40 to falsely indicate that the pool is filled. The probe 40 generates a signal that is passed to the control circuit 100. As will be hereinafter described in detail, the control circuit 100 is responsive to the signal from the probe 40 to shut off the water supply valve 30.

The vacuum pump plugs into a GFI receptacle 52 disposed in one side of the housing 12. The GFI receptacle 52 provides a standard 110 VAC current to the vacuum pump. The GFI receptacle includes a hinged cover 54, known in the trade as a while-in-use cover. The cover 54 includes one or more slots 56 to allow the passage of electrical cords through the cover 52 and a latch 58 to secure the cover in a closed position. The cover 54 protects the GFI receptacle 52 from splashing water. The GFI receptacle 52 functions as a safety feature for the pool-filling device to prevent electrical shock.

Figure 5:
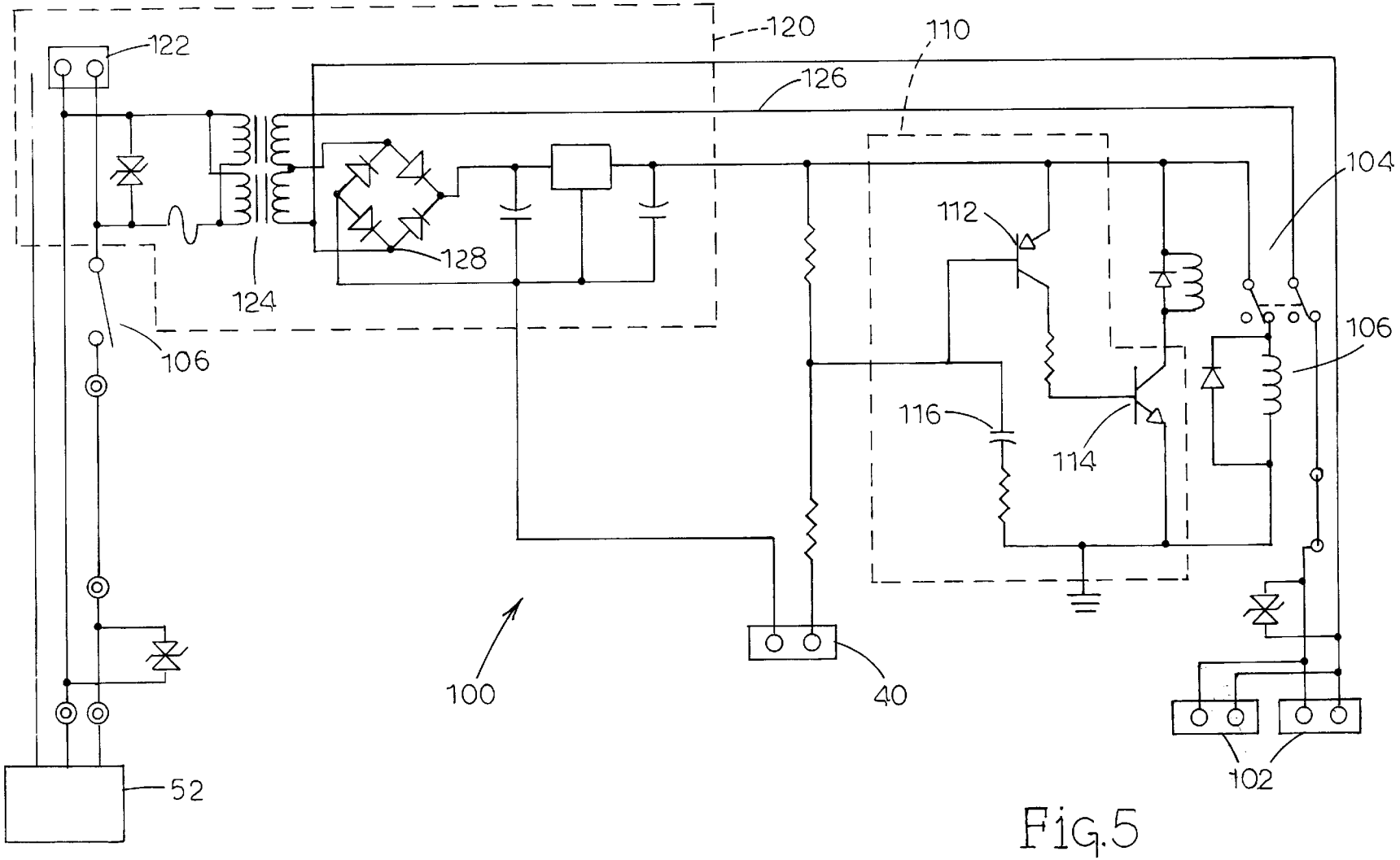
FIG. 5 is an electrical schematic of the control circuit for the pool-filling device.

FIG. 5 is an electrical schematic of the control circuit 100. The control circuit 100 includes a pair of solenoids 102, relays 104,106, sensor circuit 110, and power circuit 120. The function of the solenoids 102 is to actuate the water supply valve 30. Relay 104 controls the power to the solenoids 102. Relay 106 controls power to the GFI receptacle 52 that in turn powers the vacuum pump. Sensor circuit 110 is operatively connected to the probe 40 and controls the relays 104 and 106. Power circuit 120 provides a 24-volt AC output for actuating the solenoids 102 and a DC power supply for powering the sensor circuit 110 and relays 104, 106.

The power circuit 120 is operatively connected to a 110-volt AC power supply by a conventional plug 122. The power circuit 120 includes a transformer 124 which takes the 110-volt AC input and generates a 24-volt AC output on line 126. The 24-volt AC output is applied to the solenoids 102 via relay 104, which is normally closed. Power circuit 120 also includes a bridge circuit 128, which produces a 12-volt DC output. This 12-volt DC output is used to power the sensor circuit 110 as well as the coils of relays 104 and 106.

The sensor circuit 110, as previously mentioned, is connected to the sensor probe 40. When the sensor probe 40 detects water, a signal is applied to the base of transistor 112, which then becomes active. When transistor 112 is active, current flows to the base of transistor 114, which likewise becomes active. When transistor 114 is active, current flows through relay 104. Relay 104 opens shutting off power to the solenoids 102 and, consequently, the water supply valve 30.

Relay 106 is connected in series with relay 104. Relay 106 is a normally open relay. When relay 104 is closed, relay 106 is energized, closing the relay and supplying power to the GFI receptacle 52. When the sensor circuit 110 energizes relay 104, relay 106 is de-energized cutting off the power supply to the GFI receptacle 52.

Capacitor 116 in the sensor circuit 110 begins discharging when transistor 112 goes to an inactive state, i.e. when the probe 40 no longer detects water. The purpose of the capacitor 116 is to maintain transistor 112 in an active state for a pre-determined time period to prevent the relay 104 from turning on and off rapidly due to small waves on the surface of the pool.

Figure 6:
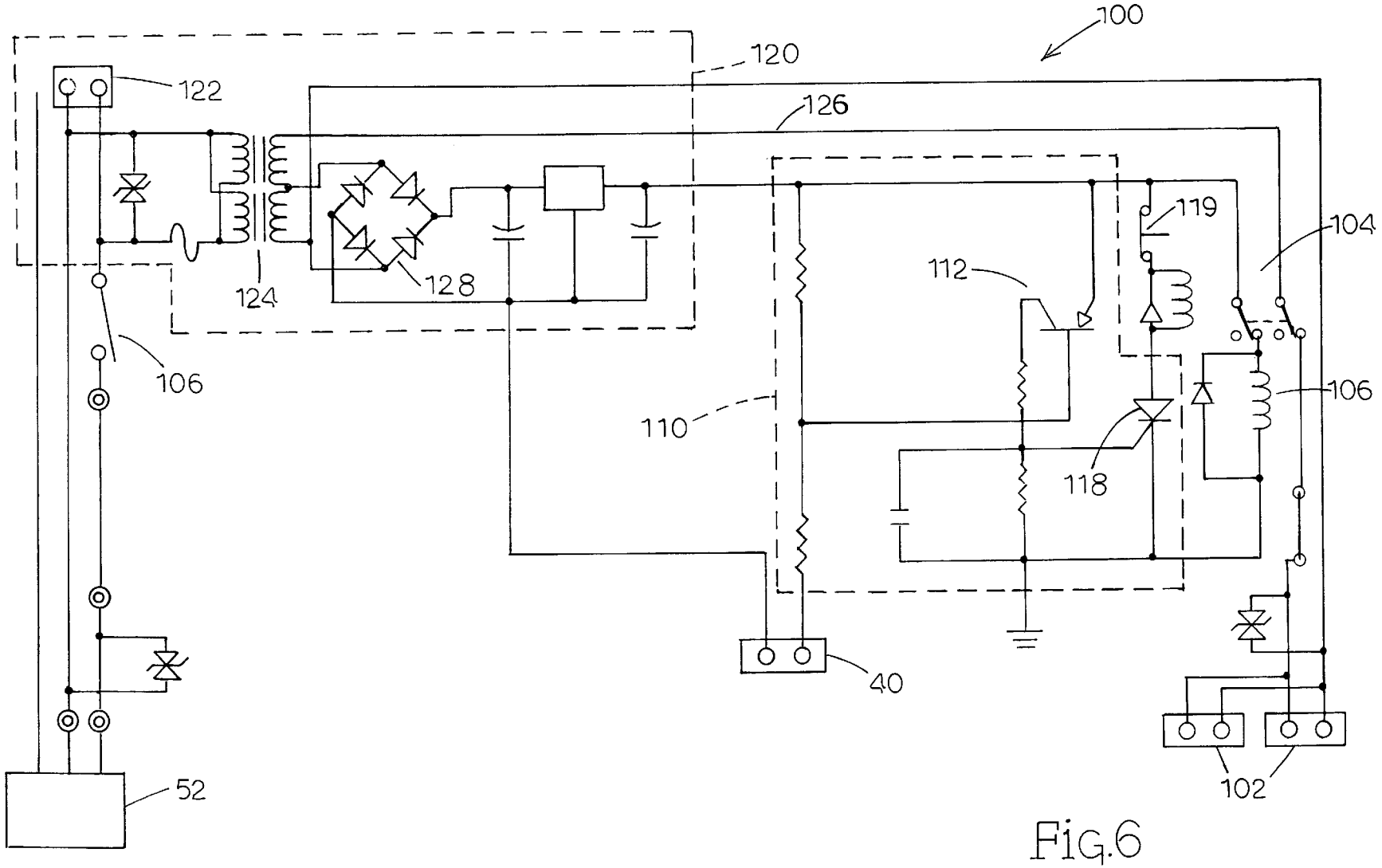
FIG. 6 is an electrical schematic for a slightly modified version of the control circuit shown in FIG. 4.

FIG. 6 shows an alternate embodiment of the control circuit 100. This embodiment is identical to the control circuit 100 of FIG. 5 with the exception of the sensor circuit 110 and the addition of a reset switch 119. In this embodiment, a transistor 112 and diode 118 control power to the relay 104. When the probe 40 senses water, a current is supplied to the base of transistor 112. When transistor 112 is active, a voltage is applied to the gate of diode 118. Diode 118 closes allowing current to flow through relay 104. A reset switch 119 is connected in series with relay 104. The function of the reset switch 119 is to restart the water supply and vacuum pump after the diode 118 has been activated. When the reset switch is pressed, the flow of current through the diode 118 is momentarily stopped. When the diode 118 is reset, relay 104 closes.

Figure 7:
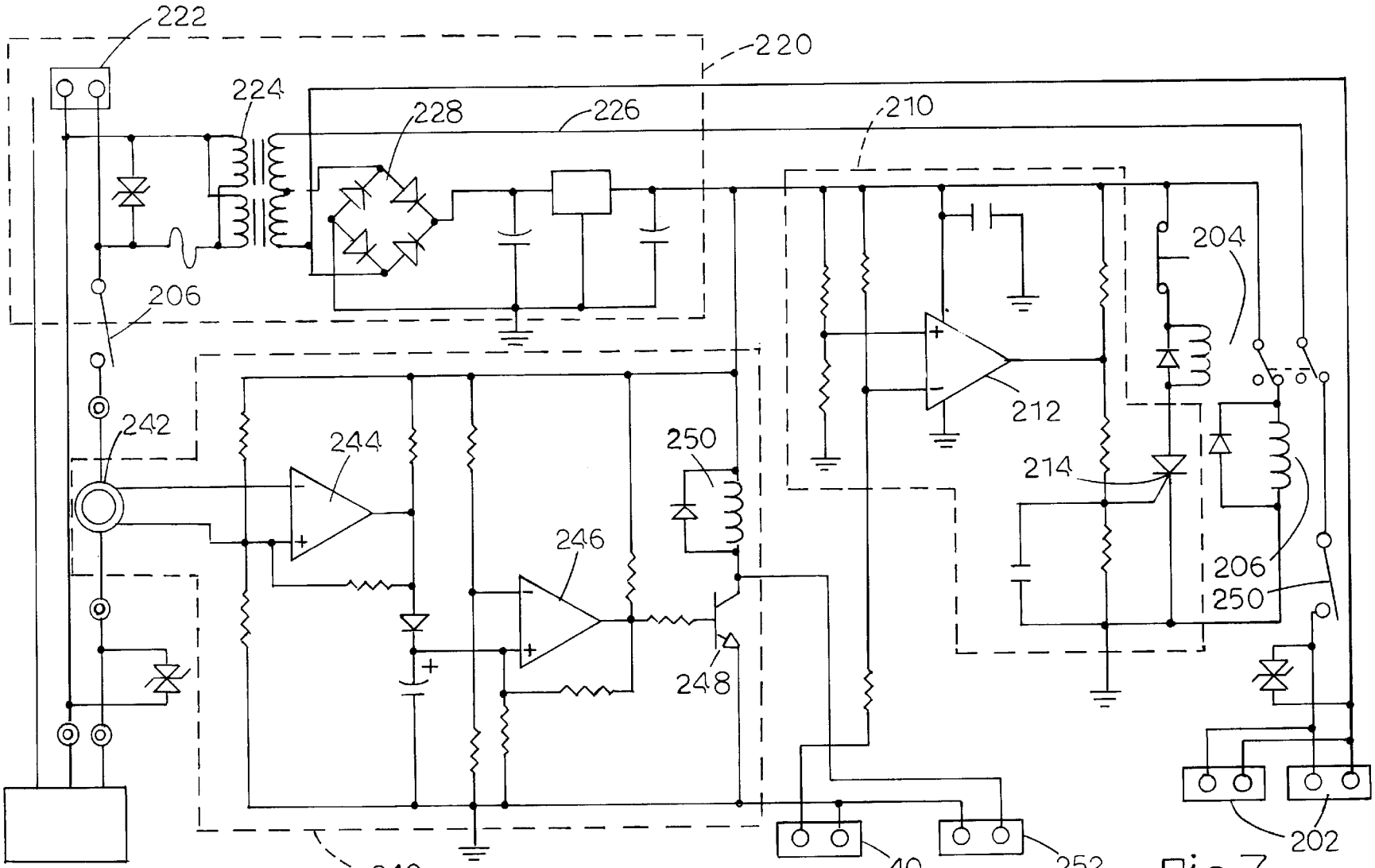
FIG. 7 is an electrical schematic of a control circuit for the pool-filling device having a current detection circuit.

FIG. 7 shows an electrical schematic for a control circuit 200 that monitors the operation of the vacuum pump and shuts off the water supply valve 30 when the vacuum pump ceases operation. The control circuit 200 includes a pair of solenoids 202, a pair of relays 204, 206, a sensor circuit 210, a power circuit 220 and a current detection circuit 240. Relay 204 actuates the solenoids 202 that control the water supply valve 30. Relay 206 controls power to the GFI receptacle 52, which in turn powers the vacuum pump. Sensor circuit 210 is operatively connected to the probe 40 and controls the relays 204 and 206. Power circuit 220 provides a 24-volt AC output for actuating the solenoids 202 at a 24-volt DC output for powering the sensor circuit 210 and relays 204, 206. Current detection circuit 240 monitors the current flowing to the vacuum pump and stops the water supply valve 30 when the vacuum pump ceases operation.

The power circuit 220 is operatively connected to a 110-volt AC power supply by a conventional plug 222. The power circuit 220 includes a transformer 224, which takes the 110-volt AC input and generates a 24-volt AC. The 24-volt AC output is applied to the solenoids 202 via relay 204, which is normally closed. Power circuit 220 also includes a bridge circuit 228, which produces a 12-volt DC output. This 12-volt DC output is used to power the sensor circuit 210 as well as the coils of relays 204 and 206.

The sensor circuit 210 is connected to the sensor probe 40. When the sensor probe 40 detects water, a signal is applied to the inverting terminal of op-amp 212, which is configured as a comparator. When op-amp 212 is active, current flows to the diode 214. When diode 214 is active, current flows through relay 204. Diode 214 latches in the active state. Relay 204 opens when it is powered shutting off power to the solenoids 202. A momentary reset switch 219 is connected in series with relay 204. The function of the reset switch 219 is to restart the water supply and vacuum pump after the diode 118 has been activated. When the reset switch 219 pressed, the flow of current through the diode 214 is momentarily stopped. When the diode 214 is reset, relay 204 closes.

Relay 206 is connected in series with relay 204. Relay 206 is a normally open relay. When relay 204 is closed, relay 206 is energized and power is supplied to the GFI receptacle 52. When the sensor circuit 210 energizes relay 204, relay 206 is de-energized cutting off the power supply to the GFI receptacle 52.

The current detection circuit 240 monitors the operation of the vacuum pump and shuts of the water supply valve 30 when the vacuum pump ceases operation. The current detection circuit includes a toroid 242, a pair of op-amps 244,246, a transistor 248, and a relay 250. The toroid 242 senses current flowing to the GFI receptacle 52. When current to the GFI receptacle 52 stops, indicating that the vacuum pump is not operating, the toroid no longer applies a signal to the op-amp 244. Op-amp 244 amplifies the signal. The output of op-amp 244 is applied to the non-inverting terminal of op-amp 246, which is configured as a comparator. When a logical high is applied to the non-inverting terminal of the op-amp 246, the output goes high. The output of the op-amp 246 is applied to the base of transistor 248. Thus, when the output of op-amp is high, the transistor 248 is active allowing the current to flow through relay 250. Relay 250 is a normally open relay. As long as current is detected by the toroid 242, the relay 250 will remain closed. When the current is not detected, the output of op-amp 246 goes low, de-energizing relay 250 and shutting off the water supply valve 30.

Figure 8:
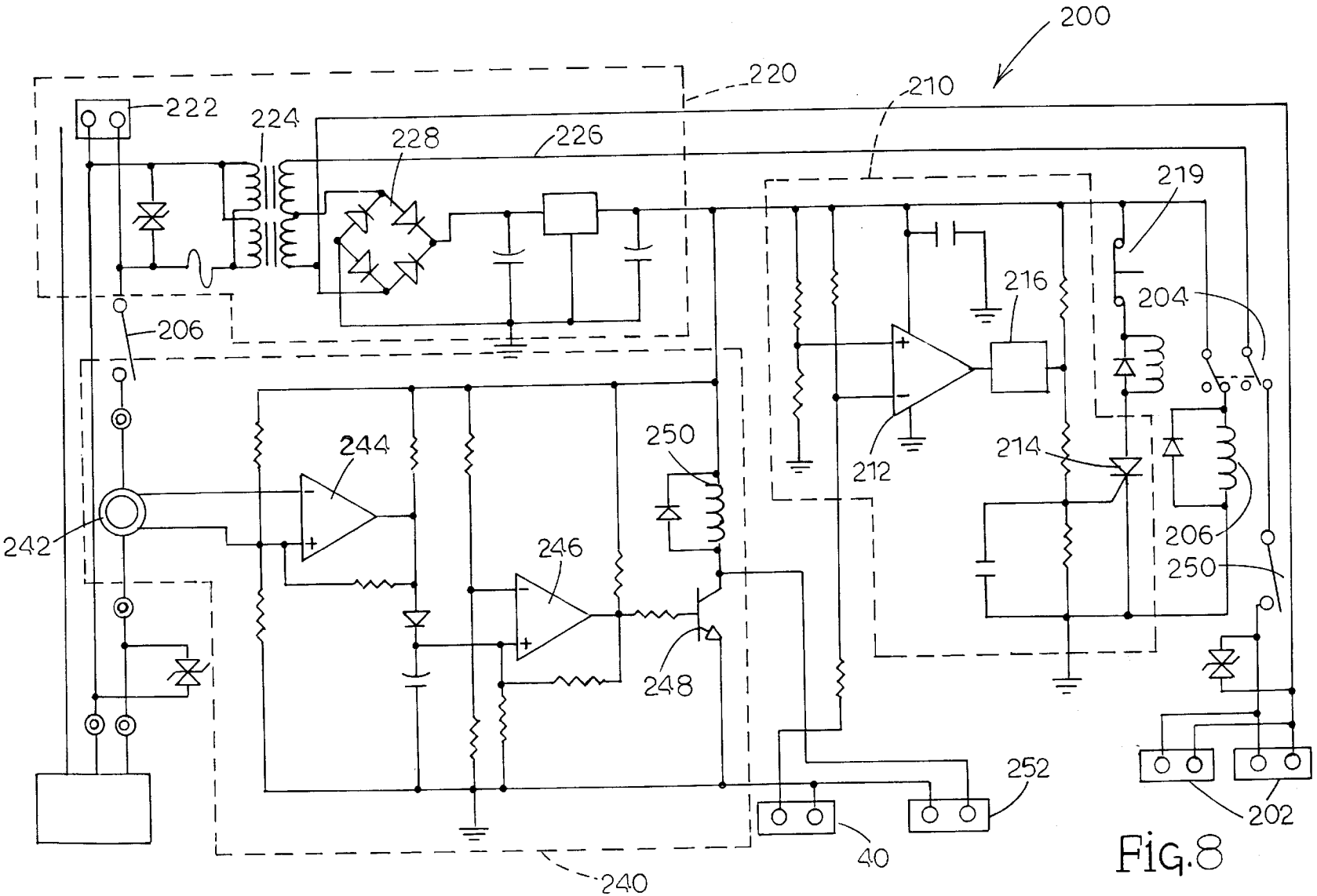
FIG. 8 is an electrical schematic for a slightly modified version of the control shown in FIG. 6.

FIG. 8 shows an alternate embodiment of the control circuit 200. This embodiment is identical to the control circuit 200 of FIG. 7 with the exception of the sensor circuit 210, which includes a timer 216. The timer 216 is connected to the output of op-amp 212. The function of the timer 216 is to delay the signal to the diode 214 to create a short delay, in the order of 10–15 minutes, between the time the probe 40 first detects water and the time the water supply shuts off. This timer 216 may be preset by the manufacturer or may be a variable timer that can be set by the user.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A pool-filling device for filling a swimming pool having a liner, comprising:

(a) a water supply valve to control the flow of water into said swimming pool;

(b) a vacuum pump to evacuate air from the space between said liner and said shell as said swimming pool is being filled;

(c) a probe for generating a signal when the water in said pool reaches a predetermined height;

(d) a controller operatively connected to said water supply valve, said vacuum pump and said probe, said controller being responsive to said signal from said probe to shut off said water supply valve and said vacuum pump when water is detected by said probe.

2. The pool-filling device according to claim 1 wherein said controller includes a current sensor to detect when said vacuum pump is operating.

3. The pool-filling device according to claim 2 wherein said controller is operative to shut off said water supply valve when said vacuum pump ceases to operate.

4. The pool-filling device of claim 3 further including a bypass switch to disable said current sensor.

5. The pool-filling device of claim 1 further including a power receptacle connected to a power source for supplying power to said vacuum pump.

6. The pool-filling device of claim 1 further including an electronic valve actuator operatively connected between said controller and said water supply valve, said valve actuator being responsive to signals from said controller to actuate and de-actuate said water supply valve.

7. A pool-filling device for filling a swimming pool having a shell and a liner, comprising:

(a) a water supply valve to control the flow of water into said swimming pool;

(b) a vacuum pump to evacuate air from the space between said liner and said shell as said swimming pool is being filled;

(c) a controller operatively connected to said vacuum pump and said water supply valve, said controller being operative to shut off said water supply valve when said vacuum pump ceases to operate.

8. The pool-filling device of claim 7 further including a probe to detect the water in said pool when it has reached a predetermined height.

9. The pool-filling device of claim 8 wherein said controller is operative to shut off said water supply valve when the water in said pool is detected by said probe.

10. The pool-filling device of claim 7 further including a power receptacle connected to a power source for supplying power to said vacuum pump.

11. The pool-filling device of claim 7 further including an electronic valve actuator operatively connected between said controller and said water supply valve, said valve actuator being responsive to signals from said controller to actuate and de-actuate said water supply valve.

12. The pool-filling device of claim 7 wherein said controller includes a current sensor for sensing current flowing to said vacuum pump, said controller being operative to shut off said water supply valve when no current is flowing to said vacuum pump.

13. The pool-filling device of claim 12 further including a bypass switch to disable said current sensor.

14. A pool-filling device for filling a swimming pool having a liner, comprising:

(a) a water supply valve to control the flow of water into said swimming pool;

(b) a power receptacle for supplying power to an electrically powered device;

(c) a probe for generating a signal when the water in said pool reaches a predetermined height;

(d) a controller operatively connected to said water supply valve, said power receptacle and said probe, said controller being responsive to said signal from said probe to shut off said water supply valve and said power receptacle when water is detected by said probe.

15. The pool-filling device according to claim 14 wherein said controller includes a current sensor to detect current to said electrically powered device.

16. The pool-filling device according to claim 15 wherein said controller is operative to shut off said water supply valve when current is not detected by said current sensor.

17. The pool-filling device of claim 16 further including a bypass switch to disable said current sensor.

18. The pool-filling device of claim 14 further including an electronic valve actuator operatively connected between said controller and said water supply valve, said valve actuator being responsive to signals from said controller to actuate and de-actuate said water supply valve.

* * * * *